US006523693B1

(12) United States Patent
Eggenberger et al.

(10) Patent No.: US 6,523,693 B1
(45) Date of Patent: Feb. 25, 2003

(54) CONVERTIBLE PACKAGING SYSTEM

(75) Inventors: Gerald Eggenberger, Plymouth, MN (US); Richard Rylicki, St. Paul, MN (US)

(73) Assignee: International Multifoods Corporation, Wayzata, MN (US)

( * ) Notice: Subject to any disclaimer, the term of this patent is extended or adjusted under 35 U.S.C. 154(b) by 268 days.

(21) Appl. No.: 09/629,354

(22) Filed: Aug. 1, 2000

(51) Int. Cl.[7] ..... B65D 5/28

(52) U.S. Cl. ..... 206/760; 206/216; 206/562; 206/761; 206/763; 229/120.13; 493/162

(58) Field of Search ..... 206/8, 216, 486, 206/562, 563, 732, 733, 736–744, 748–750, 752, 756, 759, 762, 763, 765, 541, 548; 229/120, 120.13, 171; 426/120; 493/162

(56) References Cited

U.S. PATENT DOCUMENTS 1,352,759 A * 9/1920 Markert ..... 206/486
1,501,016 A * 7/1924 Young ..... 206/765
1,592,922 A * 7/1926 Burnham ..... 206/762
2,305,087 A * 12/1942 Keller ..... 229/120.13
2,341,849 A * 2/1944 Weeks et al. ..... 206/762
2,616,558 A * 11/1952 Kay, Jr. ..... 206/752
2,823,794 A * 2/1958 Garman ..... 206/752
2,827,162 A * 3/1958 Garman ..... 206/742
3,246,738 A * 4/1966 Weiss et al. ..... 206/8
3,899,119 A * 8/1975 Roccaforte ..... 206/562
4,306,658 A 12/1981 Montealegre
4,746,010 A 5/1988 Fournier
4,957,237 A * 9/1990 Madonna et al. ..... 229/120
5,103,999 A * 4/1992 Elliott et al. ..... 229/171
5,554,417 A 9/1996 Heming
5,839,260 A 11/1998 Brody

* cited by examiner

*Primary Examiner*—Jim Foster
(74) *Attorney, Agent, or Firm*—Faegre & Benson LLP

(57) ABSTRACT

A convertible packaging system for shipping, storing and displaying a first merchandise item and for carrying a second merchandise item. The convertible packaging system includes an open-top box with an upper perimeter and a top attached to the open-top box by a hinge. The hinge includes two or more parallel folds so that the top has at least two degrees of freedom with respect to the open-top box.

15 Claims, 5 Drawing Sheets

CONVERTIBLE PACKAGING SYSTEM

FIELD OF THE INVENTION

The present invention is directed to a convertible packaging system for shipping, storing and displaying merchandise items and for subsequently carrying the same or other merchandise items. The present invention is also directed to a method of shipping merchandise to a retailer using the convertible packaging and for converting the packaging for use by customers of the retailer.

BACKGROUND OF THE INVENTION

A wide variety of cardboard or corrugated paper board cartons have been devised for shipping and storing articles of merchandise, where the same carton that is used for shipping and storing is converted to a container for a "point of purchase" display of the merchandise. One such convertible shipping/display carton is disclosed in U.S. Pat. No. 5,839,260 (Brody).

The trend towards quick food preparation by consumers encouraged by microwave ovens and other recent innovations have prompted the development of numerous types of packaging containers to speed food preparation. One such packaging container that performs the dual function of packaging food products for shipping and storage and cooking the contents is disclosed in U.S. Pat. No. 4,306,658 (Montealegre).

U.S. Pat. No. 4,746,010 (Fournier) discloses a box of cardstock for packaging a predetermined number of food items, such as taco shells and related filling materials, that is convertible by the consumer into a tray for holding at least one such food item after preparation. The box has a series of perforated score lines along which portions of the box are separated from each other to produce a tray exposing a plurality of recesses for holding the prepared items.

U.S. Pat. No. 5,554,417 (Heming) discloses a convertible packaging and handle unit that encloses an object in a first configuration. The packaging may be converted from an enclosing position to a handle position, wherein a handle is formed to facilitate the effective manipulation of the object.

BRIEF SUMMARY OF THE INVENTION

The present invention is directed to a convertible packaging system for shipping, storing and displaying a merchandise item that can subsequently be used by customers to carry the same or other merchandise items. In one embodiment, merchandise items are delivered to a retailer in the convertible packaging system. The convertible packaging is then be used by retail customers to carry the same or other merchandise items purchased from the retailer. Consequently, the present convertible packaging reduces the retailer's waste stream and eliminates the expense of current carrying containers. Constructing the convertible packaging from paperboard or cardboard reduces the use of plastic. It is also generally easier to print on paper products than on plastic. The present convertible packaging can also be folded flat prior to use, reducing shipping costs.

The convertible packaging system comprises an open-top box comprising an upper perimeter and a top attached to the open-top box by a hinge comprising two or more parallel folds. The top comprises at least two degrees of freedom with respect to the open-top box.

The top is generally co-planar with the upper perimeter in a first configuration and parallel to the upper perimeter, but inside the open-top box in a second configuration. The top is at an angle with respect to the upper perimeter and inside the open-top box in a third configuration.

The top preferably comprises a plurality of merchandise receiving openings. In one embodiment, the hinge comprises two portions and three parallel folds. In another embodiment, the two degrees of freedom comprises rotation of the top with respect to the open-top box and linear displacement of the top with respect to the open-top box.

The top typically includes one or more flaps that have a height less than a height of the open-top box. In one embodiment, the open-top box includes one or more engaging members positioned to engage with the flaps in the first configuration. The present convertible packaging can be constructed from paperboard, cardboard, or plastic.

In another embodiment, the convertible packaging system comprises an open-top box comprising an upper perimeter and a top attached to the open-top box by a hinge. The hinge is adapted to permit rotation of the top with respect to the open-top box and linear displacement of the top relative to the open-top box.

The present invention is also directed to a method of using the present convertible packaging. Merchandise items are delivered to a location using the convertible packaging in a first configuration. Customers can then use the convertible packaging in the second configuration to carry the same or other merchandise items. In one embodiment, the merchandise can be displayed at the location using the convertible packaging in the third configuration.

The present invention also includes a method for reducing the waste stream at a location. The convertible packaging is converted to a first configuration wherein the top is generally co-planar with the upper perimeter. Merchandise is delivered to the location using in the convertible packaging in the first configuration. The convertible packaging is converted at the location to a second configuration wherein the top is generally parallel to the upper perimeter, but inside the open-top box. The convertible packaging is used in the second configuration to carrying one or more items of merchandise.

In one embodiment, the merchandise is removed from the convertible packaging at the location. The convertible packaging is converted at the location to a third configuration wherein the top is at an angle with respect to the upper perimeter and inside the open-top box in a third configuration. Merchandise in displayed in the convertible packaging in the third configuration.

DETAILED DESCRIPTION OF THE INVENTION

Figure 1:
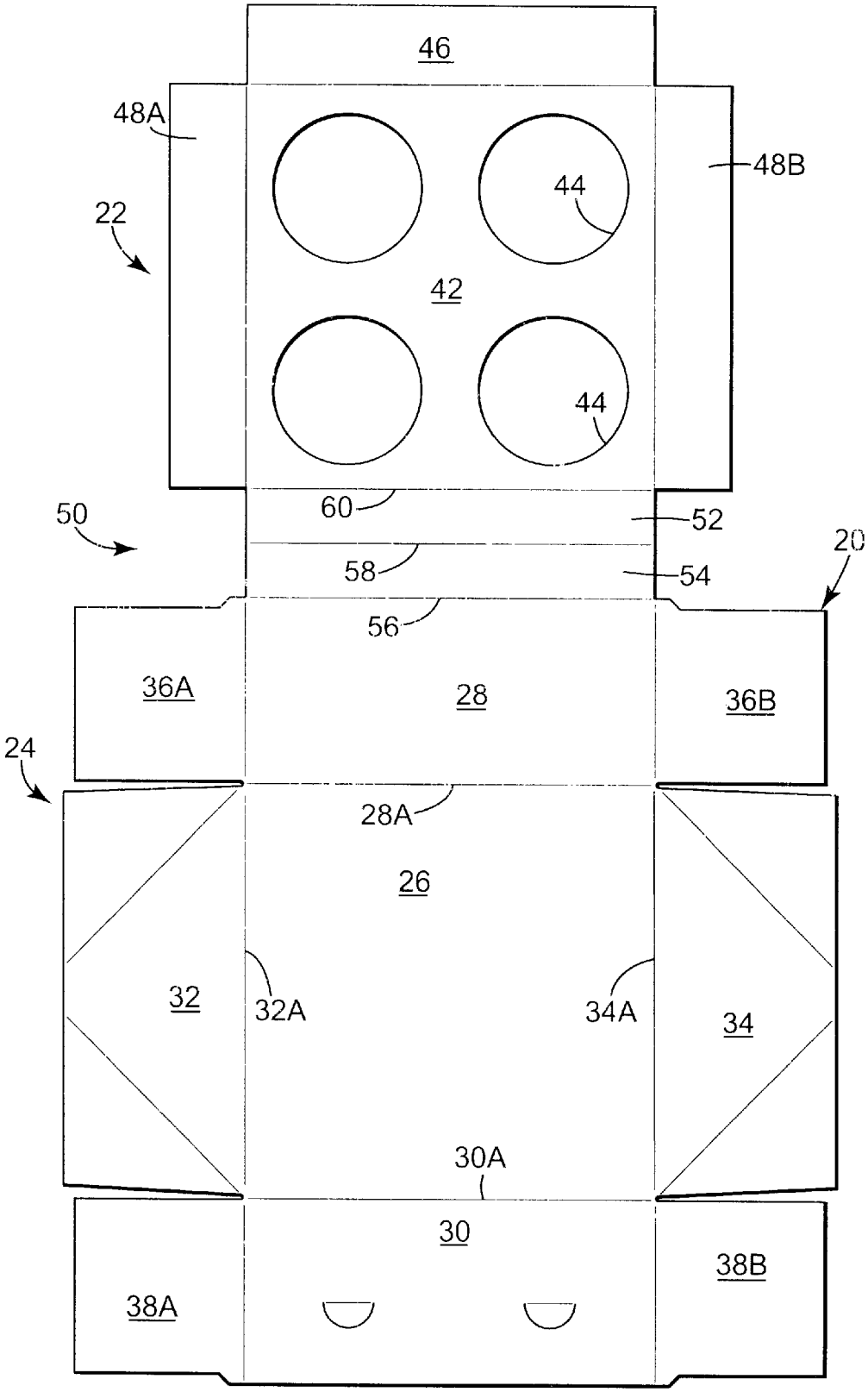
FIG. 1 is a generated view of a sheet material prior to formation of the convertible packaging in accordance with the present invention.

FIG. 1 is a generated view of an exemplary blank 20 prior to formation of the present convertible packaging. The blank 20 may be constructed from cardboard, paperboard, plastic or any other suitable semi-rigid materials. The blank 20 may be cut using a variety of techniques, such as die cutting.

The blank 20 includes upper portion 22 and a lower portion 24. The lower portion 24 includes a bottom portion 26, back portion 28, front portion 30, and a pair of side portions 32, 34. Upper portion 22 includes a top portion 42 and a plurality of merchandise receiving holes 44. The top also includes a front flap 46 and a pair of side flaps 48A, 48B.

The upper portion 22 is attached to the lower portion 24 by an accordion fold or hinge 50. As used herein, an accordion fold refers to two or more parallel fold lines. The hinge 50 includes two or more discreet portions 52, 54 comprising three fold lines 56, 58, 60. As will be discussed in detail below, the hinge 50 provides the upper portion 22 with at least two degrees of freedom with respect to the lower portion 24.

Figure 2:
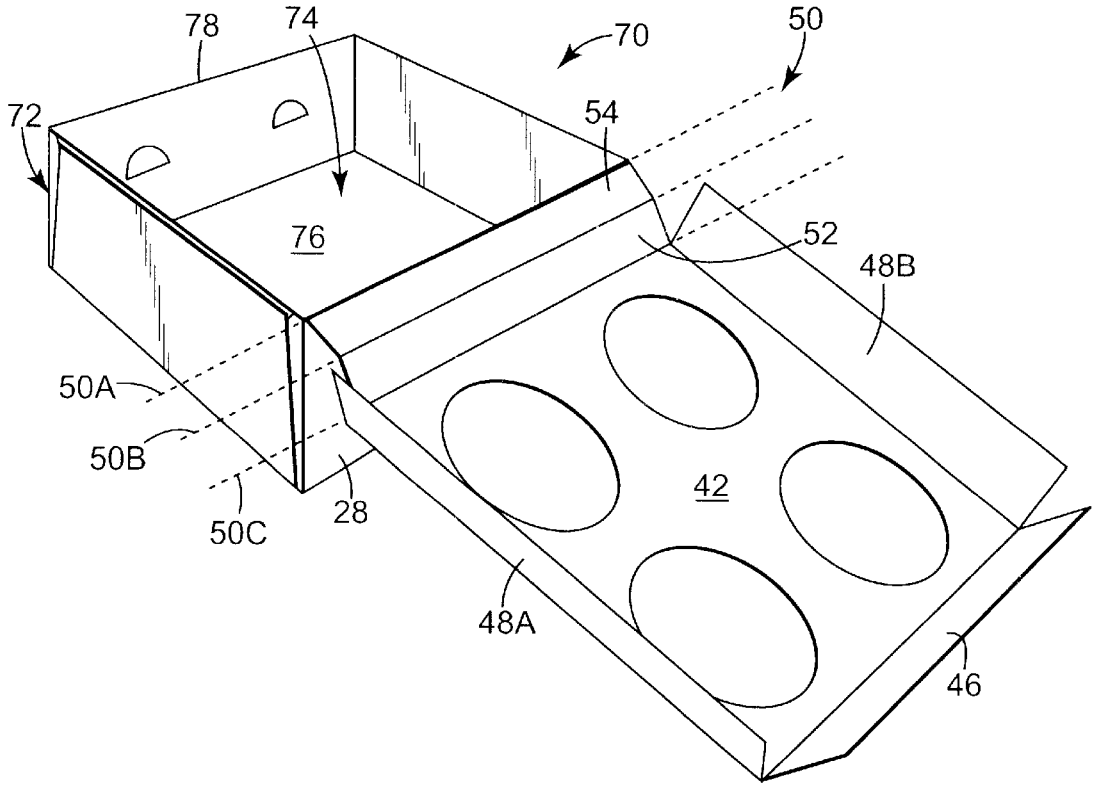
FIG. 2 is a perspective view of the present convertible packaging in an open configuration.

The portions 28, 30, 32, 34 are folded upward along folding lines 28A, 30A, 32A, 34A to form an open-top box 72 illustrated in FIG. 2. Back flaps 36A, 36B are attached to the sides 32, 34, respectively, using convention technique, such as adhesives. Similarly, front flaps 38A, 38B are attached to the sides 32, 34, respectively.

FIG. 2 is a perspective view of the present convertible packaging 70 in an open configuration. Lower portion 24 is assembled to comprise the open-top box 72 as discussed above. The open-top box 72 has an upper perimeter 78 defining an opening 74 to space 76. The open-top box 72 preferably can be folded flat for shipping as is known in the art.

The two portions 52, 54 of the hinge 50 permit the top 42 to move through two degrees of freedom. In particular, the hinge 50 permits the top 42 to rotate around any of the axes 50A, 50B, and 50C. Alternatively, the top 42 can move linearly away from the open-top box 72. That is, the members 52, 54 form an accordion structure that permits limited linear movement of the top 42. It will be appreciated that the hinge 52 may include more than the two portions 52, 54. Additionally, the relative size of the portions 52, 54 may be altered for some applications.

Figure 3:
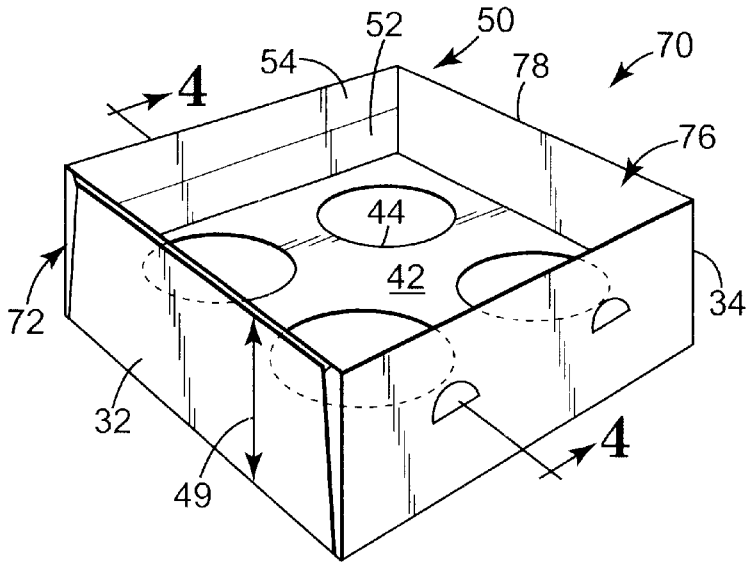
FIG. 3 is a perspective view of a convertible packaging in a first configuration in accordance with the present invention.
Figure 4:
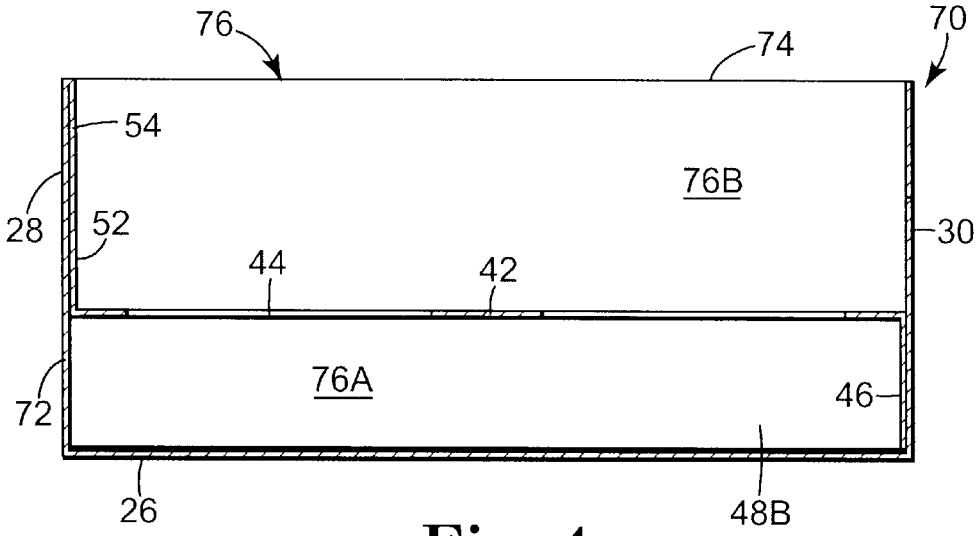
FIG. 4 is a side sectional view of FIG. 3.

FIGS. 3 and 4 illustrate the present convertible packaging 70 in a first configuration. The two portions 52, 54 of the hinge 50 extend sequentially into the space 76 to permit the top 42 to rest horizontally in the space 76 and generally parallel with the upper perimeter 78.

The flaps 46, 48A, 48B have a height less than the height 49 of the open-top box 72. Consequently, the flaps 46, 48A, 48B of the top 42 can engage with the bottom 26 to support the top 42. The merchandise receiving openings 44 permit merchandise to be recessed into space 76A located between the top portion 42 and the bottom portion 26, while a portion of the merchandise resides in the portion of the space 76*b* above the top 42. The space 76B is surrounded by portions of sidewalls 28, 30, 32, 34 of the open-top box 72. The first configuration illustrated in FIGS. 3 and 4 is particularly useful for shipping and storing merchandise, such as for example muffins. In one embodiment, a secondary cover or a shrink-wrap (not shown) can extend around the convertible packaging 70 to seal the opening 74.

Figure 5:
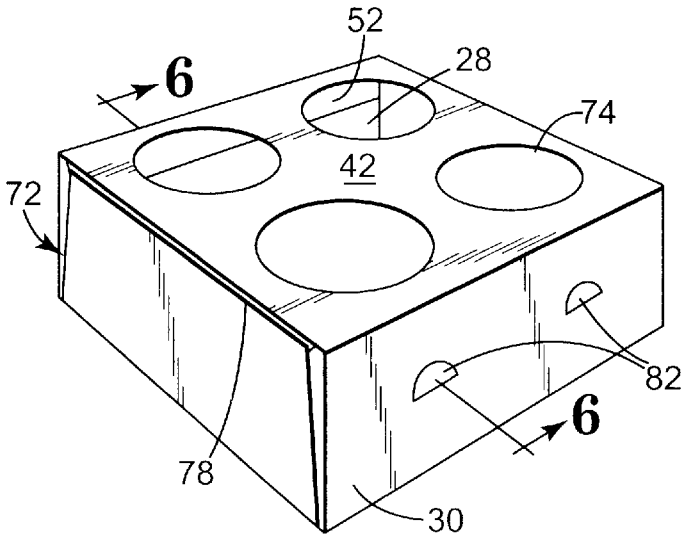
FIG. 5 is a perspective view of a present convertible packaging in a second configuration in accordance with the present invention.
Figure 6:
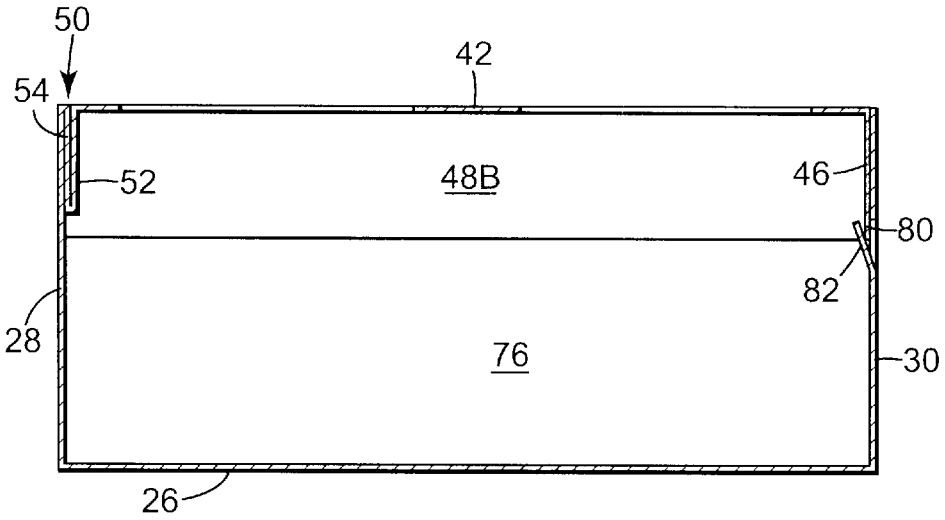
FIG. 6 is a side sectional view of FIG. 5.

FIGS. 5 and 6 illustrate the present convertible packaging 72 in a second configuration. As best illustrated in FIG. 6, portions 52, 54 of the hinge 50 are folded on top of one another so that the top 42 extends across the upper perimeter 78. The top portion 42 is generally coplanar with the upper perimeter 78 of the open-top box 72. The flaps 46, 48A, 48B can be located either inside or outside the opening 74 defined by the box-top box 72. In the illustrated embodiment, leading edge 80 of front flap 46 on the top 42 engages with slit members 82 formed in the front portion 30. The slit members 82 support the top 42 in the generally coplanar configuration with the upper perimeter 78.

In the second configuration illustrated in FIGS. 5 and 6, the space 76 between the top 42 and the bottom 26 is considerably larger than the space 76A illustrated in FIG. 4. The second configuration is particularly useful for carrying beverage cups, although smaller items, such as muffins, can also be carried.

Figure 7:
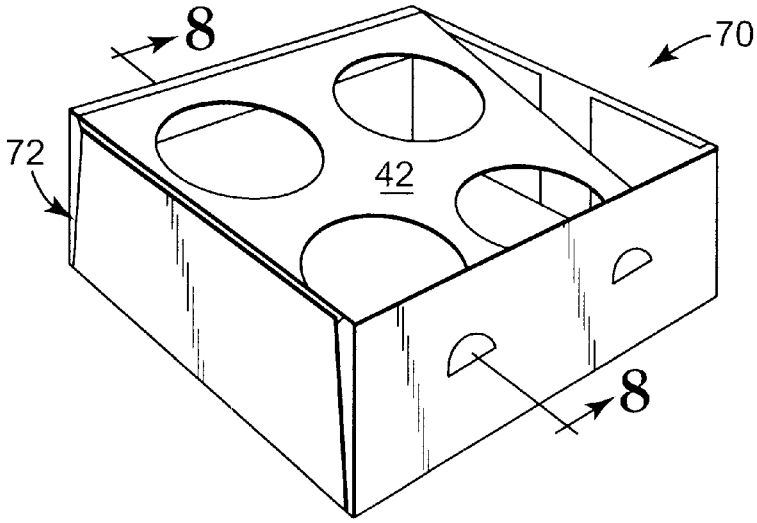
FIG. 7 is a perspective view of a present convertible packaging in a third configuration in accordance with the present invention.
Figure 8:
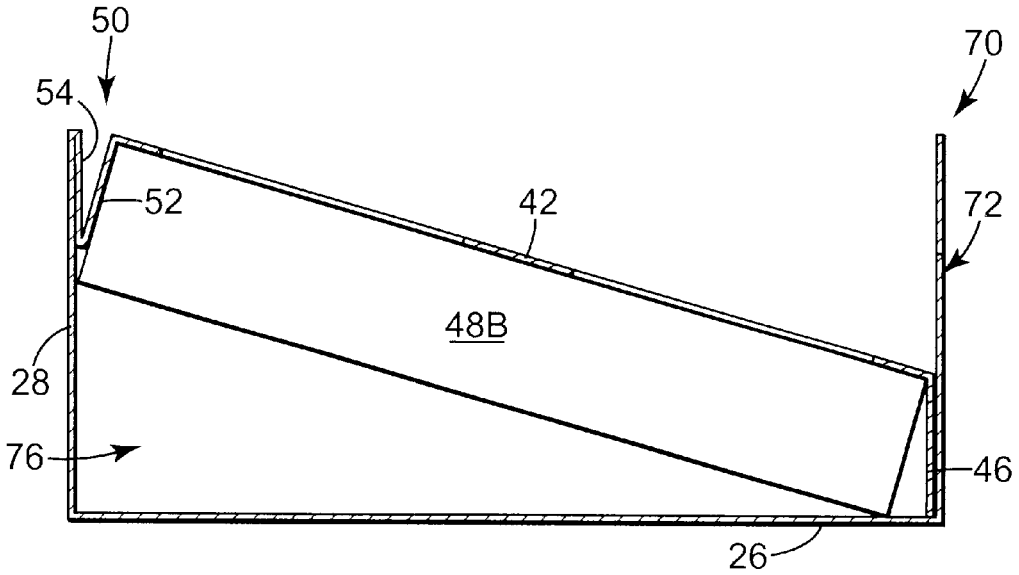
FIG. 8 is a side sectional view of FIG. 7.

FIGS. 7 and 8 illustrate a third configuration of the present convertible packaging 70 in which the top 42 extends within the space 76 in an angled configuration. The portions 52, 54 of the hinge 50 permit the top 42 to angle downward and slightly forward of the back 28. The front flap 46 rests along the bottom 26 of the open-top box 72. The third configuration illustrated in FIGS. 7 and 8 is particularly useful for displaying items prior to sale.

In the method of the present invention, merchandise can be delivered to a location, such as a retail shop, using the convertible packaging 70 in the first configuration. The convertible packaging 70 is typically sealed with a shrink wrap material or a secondary cover. The merchandise is placed in a display rack. The now empty convertible packaging 70 can then be converted to the second configuration so that customers can use it to carry the same or other merchandise items. In one embodiment, the merchandise can be displayed using the convertible packaging in the third configuration.

For example, muffins can be delivered to a retailer using the convertible packaging in the first configuration. The muffins are then placed in a bakery case. The convertible packaging is then converted to the second configuration to permit customers to carry several muffins and beverage containers simultaneously.

The present convertible packaging reduces the retailer's waste stream and eliminates the expense of current carrying containers. Constructing the convertible packaging from paperboard or cardboard reduces the use of plastic. It is also generally easier to print on paper products than on plastic. The present convertible packaging can also be folded flat prior to use, reducing shipping costs.

All of the patents and patent applications disclosed herein, including those set forth in the Background of the Invention, are hereby incorporated by reference. With regard to the foregoing description, it is to be understood that changes may be made in detail, without departing from the scope of the present invention. It is intended that the specification and depicted aspects be considered exemplary only, with a true scope and spirit of the invention being indicated by the broad meaning of the following claims.

What is claimed is:

1. A convertible packaging system comprising:

an open-top box comprising an upper perimeter; and a top for holding merchandise attached to a side wall of the open-top box by a hinge comprising two or more discrete portions having three or more parallel folds, the top comprising a perimeter generally equal to the upper perimeter of the open-top box, and the top comprising at least two degrees of freedom with respect to the open-top box.

2. The system of claim 1 wherein the top is generally co-planar with the upper perimeter in a first configuration and parallel to the upper perimeter, but inside the open-top box in a second configuration.

3. The system of claim 1 wherein the top is at an angle with respect to the upper perimeter and inside the open-top box in a third configuration.

4. The system of claim 1 wherein the top comprises a plurality of merchandise receiving openings.

5. The system of claim 1 wherein the top comprises one or more flaps having heights less than a height of the open-top box and the open-top box comprises one or more engaging members positioned to engage with the flaps in the first configuration.

6. The system of claim 1 wherein the at least two degrees of freedom comprises rotation of the top relative to the open-top box and linear displacement of the top relative to the open-top box.

7. The system of claim 1 wherein the convertible packaging comprises one of paperboard, cardboard, or plastic.

8. A convertible packaging system comprising:

an open-top box comprising an upper perimeter;

a hinge comprising two or more discrete portions having three or more parallel folds; and a top for holding merchandise attached to a side wall of the open-top box by the hinge, the top comprising a perimeter generally equal to the upper perimeter of the open-top box, and the top comprising at least two degrees of freedom with respect to the open-top box, wherein the top is generally co-planar with the upper perimeter in a first configuration and parallel to the upper perimeter, but inside the open-top box in a second configuration.

9. The system of claim 8 wherein the hinge comprises two parallel portions and three parallel folds.

10. A convertible packaging system comprising:

an open-top box comprising an upper perimeter;

a top for holding merchandise attached to a side wall of the open-top box by a hinge comprising two or more discrete portions having three or more parallel folds, the top comprising a perimeter generally equal to the upper perimeter of the open-top box, and the hinge adapted to permit rotation of the top relative to the open-top box and linear displacement of the top relative to the open-top box.

11. The system of claim 10 wherein the top is generally co-planar with the upper perimeter in a first configuration and parallel to the upper perimeter, but inside the open-top box in a second configuration.

12. The system of claim 10 wherein the top is at an angle with respect to the upper perimeter and inside the open-top box in a third configuration.

13. The system of claim 10 wherein the top comprises a plurality of merchandise receiving openings.

14. A method of reducing a waste stream at a location comprising the steps of:

providing a convertible packaging system comprising an open-top box having an upper perimeter and a top for holding merchandise attached by a hinge, the top comprising a perimeter generally equal to the upper perimeter of the open-top box, the hinge comprising two or more discrete portions having three or more parallel folds so that the top comprises at least two degrees of freedom with respect to the open-top box;

converting the convertible packaging to a first configuration wherein the top is generally co-planar with the upper perimeter;

delivering merchandise to the location using in the convertible packaging in the first configuration;

converting the convertible packaging at the location to a second configuration wherein the top is generally parallel to the upper perimeter, but inside the open-top box; and using the convertible packaging in the second configuration to carrying one or more items of merchandise.

15. The method of claim 14 comprising the steps of:

removing the merchandise from the convertible packaging at the location;

converting the convertible packaging at the location to a third configuration wherein the top is at an angle with respect to the upper perimeter and inside the open-top box in a third configuration; and displaying merchandise in the convertible packaging in the third configuration.

* * * * *